US005752423A

United States Patent [19]

Rawson

[11] Patent Number: 5,752,423

[45] Date of Patent: May 19, 1998

[54] ULTRASONIC CUTTING DEVICE

[75] Inventor: Francis F. H. Rawson, Leicester, Great Britain

[73] Assignee: Nestec S.A., Vevey, Switzerland

[21] Appl. No.: 619,089

[22] Filed: Mar. 20, 1996

[30] Foreign Application Priority Data

Mar. 21, 1995 [GB] United Kingdom ..... 9505684

[51] Int. Cl.[6] ..... B26D 1/45

[52] U.S. Cl. ..... 83/508.3; 83/956

[58] Field of Search ..... 83/956, 932, 701, 83/13, 508.3; 451/165

[56] References Cited

U.S. PATENT DOCUMENTS

| | | | |
|---|---|---|---|
| 2,717,012 | 9/1955 | Schneider . | |
| 2,813,377 | 11/1957 | Duran | 451/165 |
| 2,919,731 | 1/1960 | Schneider et al. . | |
| 3,031,804 | 5/1962 | Thatcher et al. | 451/165 X |
| 3,044,510 | 7/1962 | Schneider et al. . | |
| 3,416,398 | 12/1968 | Bodine, Jr. . | |
| 3,471,724 | 10/1969 | Balamuth | 451/165 X |
| 3,630,244 | 12/1971 | Cromeens et al. | 83/665 X |
| 3,742,796 | 7/1973 | McMillan . | |
| 3,750,513 | 8/1973 | Cromeens | 83/665 X |
| 3,848,461 | 11/1974 | Hetherington et al. | 73/640 |
| 4,222,297 | 9/1980 | Jackson | 83/701 X |
| 4,751,916 | 6/1988 | Bory | 451/165 X |
| 4,759,249 | 7/1988 | Held | 83/508.3 X |
| 5,127,296 | 7/1992 | Held | 83/508.3 X |
| 5,226,343 | 7/1993 | Rawson et al. | 83/701 X |
| 5,228,372 | 7/1993 | Harrop et al. | 83/701 X |
| 5,367,936 | 11/1994 | Held et al. | 83/698.61 |
| 5,437,215 | 8/1995 | Hamilton | 83/701 |

FOREIGN PATENT DOCUMENTS 2219245 6/1989 United Kingdom .

*Primary Examiner*—Maurina T. Rachuba
*Attorney, Agent, or Firm*—Vogt & O'Donnell, LLP

[57] ABSTRACT

An ultrasonic cutting device includes an ultrasonic vibrating device which, in operation, generates ultrasonic vibrations in a longitudinal direction. At least one solid horn, whose length is a multiple of half-wavelengths, is connected to and extends away from the vibrating device, in the longitudinal direction of the ultrasonic vibrations. A plurality of tubular spacer horns, each having vibrating end faces and a length of substantially one half-wavelength, are arranged end to end about and along the solid horn. At least one cutting blade is connected to the solid horn, between the vibrating end faces of a pair of adjacent tubular spacer horns. The blade is positioned in a plane extending transversely to the longitudinal axis of vibrations. A clamping device for pressingly retaining the tubular spacer horns along the solid horn is positioned at the end of the solid horn, away from the vibrating means.

15 Claims, 1 Drawing Sheet

ULTRASONIC CUTTING DEVICE

BACKGROUND OF THE INVENTION

The present invention relates to improved ultrasonic cutting devices and methods.

In conventional prior art ultrasonic cutting devices and methods, a cutting blade is mounted on an ultrasonic vibrating device with the blade lying in a plane containing the longitudinal axis of vibrations. In operation, the blade is vibrated in its plane and is moved through the article to be cut in that plane. Difficulty is experienced with such devices and methods, in that the depth of cut which is attainable is limited; cutting in general has been limited to thin articles, such as paper, cloth and thin plastic sheets.

In U.S. Pat. No. 5,226,343, the entirety of which is hereby incorporated by reference, there is described an ultrasonic cutting device and cutting method wherein a cutting blade is mounted on an ultrasonic vibrating device in a manner such that the blade lies in a plane extending transverse, preferably at right angles, to the longitudinal axis of vibrations generated by the ultrasonic vibrating device. In operation, the vibrated blade moves back and forth, transverse to the plane in which is passed through the article, effecting a removal of the material of the article along the line of cut. The ultrasonic cutting device enables the cutting of blocks of substantial depth, and/or the providing of a number of parallel cuts simultaneously. Brittle or friable materials which may shatter if dropped, e.g., honeycomb or crystalline, are also readily cut.

The ultrasonic cutting device illustrated in U.S. Pat. No. 5,226,343 includes a vibrating means in the form of a horn, usually rod shaped, having a front face which is caused to vibrate at ultrasonic frequency. One or more support members are secured to the ultrasonic horn. Each support member is vibrated by the ultrasonic horn and each supports a plurality of blades secured at antinode positions, where the blades are caused to vibrate. The support members are also known as spacer horns, because the blades are spaced along them. As illustrated, the cutting blades are attached at their respective mid portions to individual support members.

In U.S. Pat. No. 5,228,372, the entirety of which is hereby incorporated by reference, there is disclosed an improved ultrasonic cutting device and method. To deliver more cutting power, the blades are secured at their respective ends to a pair of adjacent parallel support members which extend from the vibrating face of the ultrasonic vibrating device.

In the ultrasonic cutting devices disclosed in each of the above-noted patents, the support members or spacer horns are formed from a number of separate solid pieces, preferably rod-shaped, each piece being one-half wavelength in length. The pieces are joined together end to end, conventionally by means of grub screws, which enables the end faces of the respective pieces to be very tightly fastened by applying a rotational torque. The cutting blades are fixed between the end faces which form the antinodes, where maximum vibrations occur.

Since each support member is made of a plurality of pieces in the above-noted devices, there are possible stress concentration failure initiation points. In addition, the blades are subjected to rotational torque on fastening and unfastening, and the replacement of blades requires each pair of end faces to be unfastened one by one. Each support member is also ultrasonically complex owing to the plurality of pieces having spanner flat or holes, usually necessary to enable the use of a spanner for tightening the grub screws.

SUMMARY OF THE INVENTION

It has now been found that the efficiency and use of the above-noted ultrasonic cutting devices and methods is significantly improved by providing a plurality of tubular spacer horns around and along a solid longitudinal support member/horn. In this manner, the cutting blades are not subjected to a rotational torque, and the blades can be individually and quickly replaced by slackening end nuts or releasing clamping means which retain the spacer horns on the longitudinal support member/horn. The tubular spacer horns can be ultrasonically simple—without spanner flat or holes—and since the solid horn needs no internal studs when it is a one piece device, there are no stress concentration failure initiation points.

Accordingly, the present invention provides an ultrasonic cutting device comprising an ultrasonic vibrating means, a horn, spacer horns, a cutting blade, or blades, and clamping means wherein the horn extends from the vibrating means and comprises a solid member, the cutting blade extends transversely with respect to the solid member horn, each of the spacer horns comprise a tubular body positioned about the solid member end-to-end, each blade is positioned between two spacer horn ends, and the clamping means pressingly retains the spacer horns fixedly.

The ultrasonic vibrating means, in operation, generates vibrations in a direction about a longitudinal axis. The horn comprising a solid member is connected with and extends from the vibrating means to a solid member end portion displaced a distance away from from the vibrating means and with more particularity, the solid member has a length which, in operation, is a multiple of half-wavelengths, and there may be plurality of solid horn members connected with the vibrating means. The cutting blade is positioned and the spacer horns are pressingly retained so that, in operation, the cutting blade is positioned substantially at a wavelength antinode, and the device includes at least one cutting blade so positioned, and in the case of a plurality of cutting blades, a number of spacer horns are provided so that each blade is positioned between two spacer horns, and with more particularity, the spacer horns have a length of one half-wavelength. The clamping means is positioned at the end of the solid member horn, away from the vibrating means.

The present invention also provides a method for cutting a material which comprises generating and transmitting ultrasonic vibrations through and in the longitudinal direction of at least one elongated solid horn which is circumscribed by a plurality of spacer horns positioned end to end about and along the solid horn. The solid horn has connected thereto at least one cutting blade, which is positioned between adjacent spacer horns and which extends in a plane transverse to the longitudinal axis of vibrations so as to be vibrated transversely to the longitudinal axis of vibrations. The vibrated cutting blade is passed through the article to be cut, either by moving the blade through the material or by moving the material through the blade.

DETAILED DESCRIPTION OF THE INVENTION

The ultrasonic vibrating means to which the solid horn is connected is conveniently provided in the form of a horn, hereinafter referred to as a mother horn, which is caused to vibrate at ultrasonic frequency by a source of ultrasonic power, e.g., a transducer. The transducer is secured to one end of the mother horn, either directly or indirectly, at the end opposite to that which is connected to the solid horn. When the mother horn is secured to the transducer indirectly, this may be through a booster device which adds gain or increased amplitude of vibration, or through a rod-shaped ultrasonic horn which has vibrating faces at each end, one of which is secured to the transducer.

The length of the solid horn may be up to, for example, 20 half wavelengths, but for practical purposes the length is usually from 3 to 12 and preferably from 5 to 10 half wavelengths.

The solid horn may conveniently be connected to the mother horn by conventional means, such as with a grub screw, a threaded end with shoulder or by welding. The solid horn is preferably made of one piece. Optionally, however, it may be made of a plurality of pieces, each half a wavelength in length and screwed together by grub screws.

The tubular spacer horns are adapted to slide about and along the solid horn. The length of each tubular spacer horn is adapted to be slightly more or less than half a wavelength, to allow for blade thickness and blade material. The tubular spacer horns may be provided with a lip or washer segment at their vibrating end faces in order to apply uniform pressure to the blade and adjacent horn. The tubular spacer horns may, if desired, be shaped by conventional means to give amplitude gain.

The mother horn, the solid horns and the tubular spacer horns are preferably made of high fatigue strength aluminum or titanium alloys.

The cutting blades are conveniently made of hard, tough or flexible materials, e.g., steel, graphite impregnated steel, tempered high tensile steel, flexible ceramics such as zirconium types or fibre reinforced composites. They may be coated with non-stick and/or hard wearing non-abrasive coatings such as chrome, polytetrafluoroethylene or flexible ceramics or by other surface-hardening treatments. The cutting edge of the blade may be spark-eroded or otherwise cut to produce a hollow edge.

The clamping means for pressingly retaining the tubular spacer horns along the solid horn may be provided by one of a variety of options. For example, the end of the solid horn remote from the vibrating means may be threaded and a nut may be provided for screwing onto the threaded end. Preferably, the length of the nut should be one half a wavelength or such that the whole clamped assembly vibrates at the required frequency. Alternatively, the clamping means may be provided by a hydraulic or pneumatic cylinder which is adapted to apply force to the end of the tubular spacer horn remote from the vibrating means.

Means may be provided to inhibit and avoid friction welding between the tubular spacer horns and the solid horn. One possibility is to provide either the solid horn or the tubular spacer horns with a nodal flange bearing. Alternatively, a bearing tube may be fitted onto the solid horn, within the tubular spacer horns, in order to isolate friction variation effects. The bearing tube is advantageously made of fibre or plastics bearing material, e.g., TUFNOL. If desired, passages may be provided between the bearing tube and the solid horn and between the bearing tube and the tubular spacer horns for blowing or pumping cooling air or fluid through the cavities.

Advantageously, there may be two solid horns (or multiple pairs of solid horns) connected to the ultrasonic vibrating means, arranged parallel to one another so that cutting blades may be supported by vibrating end faces of adjacent tubular spacer horns surrounding the solid horns, each blade advantageously being secured at each of its respective ends to a pair of parallel solid horns. Such a device with a double-drive has more cutting power than a single-drive device, where the cutting blades are attached at their mid portions to one solid horn secured to the ultrasonic vibrating means. In the single-drive and double-drive embodiments, one or more further parallel solid horns, each supporting one or more blades, may advantageously be secured to the ultrasonic vibrating means.

The cutting blades may be wide, narrow, thin or they may be wires. They may be round, triangular or roughly square in shape, but they are preferably rectangular, e.g., from 10 to 100 mm long and from 1 to 22 mm wide. When the blades are roughly square or rectangular in shape, they are advantageously profiled so that they are narrower along a portion of their lengths than at their ends. For example, from 40% to 90% and preferably from 50% to 70% of their length between the ends is narrower and the width may be up to 60% less than at the ends. The thickness of the blades may be from 0.25 to 1.5 mm and more usually from 0.5 to 1.35 mm, especially from 0.85 to 1.2 mm. The blade may be provided with a single aperture in its body, e.g., in the middle or mid portion, to enable it to slide along the solid horn, whereas a blade which is driven at each end may be provided with an aperture at each end. The cutting blades are placed in position by sliding the tubular spacer horns and blades successively along the solid horn so that a blade is positioned between adjacent end faces of two tubular spacer horns. Advantageously, the aperture(s) provided in the cutting blade may be cut away to give a "horseshoe shape" to enable easy disassembly and blade replacement without removing the tubular spacer horns.

It should be understood that the vibrating end faces of the tubular spacer horns are positioned substantially at "antinodes," the crest of a sinusoidal oscillation. As used herein, an antinode shall be understood as meaning one quarter wavelength ±10% from the node, the node being a stationary point where there is no vibration. The vibrating faces of the spacer horns, between which are positioned the cutting blades, are preferably positioned ±5%, more preferably ±2%, even more preferably ±1% from the node. Most preferably, they are positioned at the true antinodal point, i.e., exactly one quarter wavelength from the node.

The method of cutting an article by means of an ultrasonic cutting device as hereinbefore defined according to the present invention comprises generating ultrasonic vibrations along the axis of the solid horn and tubular spacer horns and passing the cutting blade through the article. The frequency used may be within the audio range from 5 to 15 KHz, but is preferably between 15 and 100 KHz, especially from 20 to 40 KHz. The movement of the blade relative to the article to be cut may, if desired, be achieved by moving the article through the blade. However, it is also possible to move the blade through the article to be cut.

The ultrasonic cutting device of the present invention may be used in each of the methods disclosed and claimed in U.S. Pat. No. 5,226,343 and U.S. Pat. No. 5,228,372. Materials which may be cut by this device include metal, stone, plastics, confectionery, chocolate, food, pharmaceuticals, cosmetics, paper and cardboard. The device is particularly useful for cutting brittle or friable materials of any thickness and may be used to cut frozen food products.

The ultrasonic cutting devices and methods of the present invention are further illustrated in the accompanying drawings.

DETAILED DESCRIPTION OF THE DRAWINGS

Figure 1:
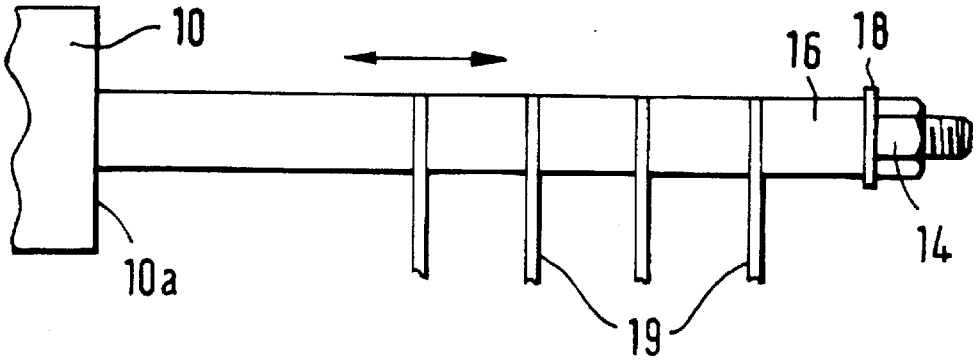
FIG. 1 is a diagrammatic side plan view of an ultrasonic cutting device of the present invention.
Figure 2:
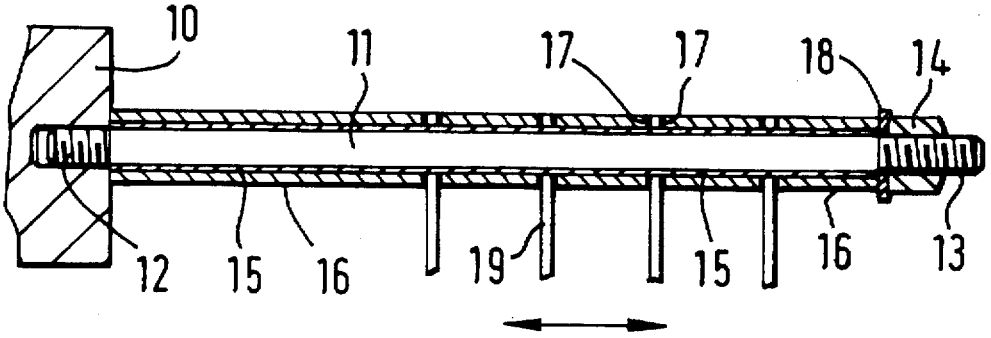
FIG. 2 is a diagrammatic side sectional view of an ultrasonic cutting device of the present invention.

Referring to FIGS. 1 and 2 of the drawings, the ultrasonic cutting device of the present invention comprises a mother horn 10 having a front face 10*a*. As illustratively represented in FIG. 2, a solid horn 11, having a length such as six half wavelengths and made of high strength titanium alloy, is threaded and screwed at one end 12 into the mother horn 10. The solid horn 11 is a member which extends longitudinally from the mother horn 10 to an end 13 which is displaced a distance away from the mother horn 10 and which also is threaded, and a nut 14, which extends in the longitudinal direction of the mother horn 10 about a nut axis for a length of one half wavelength, is screwed about the threaded end 13 to pressingly retain and secure the tubular spacer horns 16 along the solid horn 11.

Surrounding the solid horn 11 is a bearing tube 15, e.g., made of TUFNOL, forming an inner sleeve. Surrounding the bearing tube are tubular spacer horns 16, e.g., made of high strength titanium alloy, each having a length of approximately half a wavelength and being adapted to slide along the tube member 15 (hereinbefore also referred to as the "bearing tube"). Thus, each of the spacer horns 16 comprises a tubular body which extends between opposing end faces and about a body hollowed interior portion suitable for circumscribing solid horn 11. Thus, as illustrated, the spacer horns 16 are aligned in an end face-to-end face relation and contain the solid horn within the hollowed body interior portion, and as illustrated in FIG. 2, the end faces of adjacent tubular spacer horns are formed with lips 17, and the end of the tubular spacer horn is displaced a distance away from from the mother horn 10 and adjacent the nut 14 is formed with a flange 18. The lips 17 of the tubular spacer horns enable uniform pressure to be applied to the blades and adjacent horn.

Figure 3:
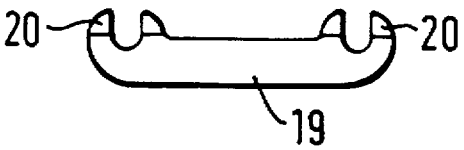
FIG. 3 is a plan view of a cutting blade used in the ultrasonic cutting device of the present invention.

Cutting blades 19, e.g., made of steel, are clamped between adjacent end faces, illustrated in FIG. 2 with lips 17, of the tubular spacer horns. As illustrated in FIG. 3, when the cutting blade 19 is connected at each end to one of two parallel solid horns 11, the clamping ends of the blade may be cut away to give a horseshoe shape 20. If the cutting blade is attached only to a single solid horn, i.e., solid horn 11 the blade may be provided with a cut-out shape in a central portion of the blade which is similar to the illustrated horseshoe cut-out shape 20.

To assemble the ultrasonic cutting device illustrated in FIGS. 1 and 2, the solid horn 11 is screwed into the mother horn 10 and the bearing tube member 15 is then slid over the solid horn. The tubular spacer horns 16 and blades 19 are slid along the bearing tube 15 successively so that the blades 19 are positioned between adjacent end faces illustrated in FIG. 2 with lips 17, of the spacer horns 16 held by their clamping apertures. The nut 14 is screwed onto the threaded end 13 of the solid horn 11 until the tubular spacer horns 16 clamp the blades 19 tightly.

In operation, a transducer (not shown) produces ultrasonic power causing the front face 10*a* of the mother horn and the end faces of the tubular spacer horns 16 to vibrate at 20 KHz, which causes the blades 19 to vibrate in the direction of the arrows shown in FIGS. 1 and 2. The device passes downwards through a wafer biscuit supported on a table (not shown) to excavate several cuts simultaneously.

Various modifications of the ultrasonic cutting devices and methods of the present invention may be made without departing from the spirit and scope of the foregoing disclosure. Unless otherwise stated, the inventions may be carried out and embodied in the absence of elements, constituent components and/or process steps and/or parameters not specifically disclosed or excluded herein.

I claim:

1. An ultrasonic cutting device comprising:

an ultrasonic vibrating means for generating ultrasonic vibrations which provide, in operation, with respect to a longitudinal axis of vibration in a direction away from the vibrating means, sinusiodal oscillation wavelength nodes and antinodes; and a horn comprising a solid member which is connected with and extends away from the vibrating means in the longitudinal axis of vibration to a member end portion at a position displaced a distance away from the vibrating means; and a plurality of spacer horns, a cutting blade positioned between two spacer horns and a clamping means positioned for pressingly retaining the spacer horns wherein each spacer horn comprises a tubular body which extends between opposing body end faces and about a body hollowed interior portion suitable for containing the solid member therein and wherein the spacer horns are aligned in an end face-to-end face relation and contain the solid member within the hollowed body interior portion, wherein the cutting blade extends transversely with respect to the solid member and away from the spacer horns and wherein the spacer horns are positioned and the clamping means pressingly retain the spacer horns so that, in operation, the cutting blade is positioned substantially at a wavelength antinode position.

2. A cutting device according to claim 1 further comprising at least one additional cutting blade and wherein each additional blade is positioned between the end faces of two spacer horns and wherein each additional cutting blade extends transversely with respect to the solid member and so that, in operation, each additional cutting blade is positioned substantially at a wavelength antinode position.

3. A cutting device according to claim 1 wherein the spacer horns have a length which is, in operation, substantially one-half wavelength of the oscillation wavelength.

4. A cutting device according to claim 1 further comprising means positioned between the spacer horns and the solid member for inhibiting friction welding.

5. A cutting device according to claim 4 wherein the means for inhibiting friction wielding comprises a tube member positioned between the spacer horns and the solid member.

6. A cutting device according to claim 5 wherein the tube member is comprised of a material selected from the group consisting of fiber and plastic.

7. A cutting device according to claim 5 wherein the tube member is configured so that there are passages which extend longitudinally between the tube member and the solid member and between the tube member and the spacer horns.

8. A cutting device according to claim 1 wherein the spacer horns comprise a nodal flange bearing for inhibiting friction welding.

9. A cutting device according to claim 1 wherein the solid member comprises a nodal flange bearing for inhibiting friction welding.

10. A cutting device according to claim 2 wherein the solid member has a length which is, in operation, a multiple of a half-wavelength of the oscillation wavelength.

11. A cutting device according to claim 10 wherein the multiple is from 3 to 12.

12. A cutting device according to claim 1 wherein the solid member end portion comprises screw threads and the clamping means is a nut screwed on the screw threads.

13. A cutting device according to claim 12 wherein the nut extends in the longitudinal direction about a nut axis for a length of one half-wavelength of the oscillation wavelength.

14. A cutting device according to claim 1 wherein the clamping means is a cylinder selected from the group consisting of hydraulic cylinders and pneumatic cylinders.

15. A cutting device according to claim 1 wherein the solid member comprises a plurality of solid member pieces screwed together.

* * * * *